US006550167B2

(12) United States Patent
Huang

(10) Patent No.: US 6,550,167 B2
(45) Date of Patent: Apr. 22, 2003

(54) ADVERTISEMENT STAND

(76) Inventor: Chih-Yuan Huang, 15F-3, No. 153, San-To 3rd Rd., Chien-Chen Dist., Kaohsiung City (TW)

( * ) Notice: Subject to any disclaimer, the term of this patent is extended or adjusted under 35 U.S.C. 154(b) by 64 days.

(21) Appl. No.: 09/845,452

(22) Filed: Apr. 24, 2001

(65) Prior Publication Data

US 2002/0005002 A1 Jan. 17, 2002

(51) Int. Cl.[7] ..... G09F 19/00; G09F 13/24

(52) U.S. Cl. ..... 40/406; 40/407; 40/439; 40/441

(58) Field of Search ..... 40/406, 407, 409, 40/412, 422, 439, 441

(56) References Cited

U.S. PATENT DOCUMENTS

| | | | | | |
|---|---|---|---|---|---|
| 2,412,171 | A | * | 12/1946 | Petry | 40/406 |
| 3,706,149 | A | * | 12/1972 | Olivieri | 40/407 |
| 3,964,194 | A | * | 6/1976 | Gugeler | 40/406 |
| 4,939,859 | A | * | 7/1990 | Bradt | 40/406 |
| 5,349,771 | A | * | 9/1994 | Burnett | 40/406 |
| D390,157 | S | * | 2/1998 | Burnett | 40/406 |
| 5,791,078 | A | * | 8/1998 | Maranto et al. | 40/406 |
| 6,187,394 | B1 | * | 2/2001 | Johnson et al. | 40/407 |
| 6,241,359 | B1 | * | 6/2001 | Lin | 40/406 |

* cited by examiner

*Primary Examiner*—S. Joseph Morano
*Assistant Examiner*—Jason H. Bellinger
(74) *Attorney, Agent, or Firm*—Fulwider Patton Lee & Utecht, LLP

(57) ABSTRACT

An advertisement stand includes a transparent hollow member mounted on a hollow base, and confining a water-tight inner space filled with a liquid body. The hollow member has a surrounding wall adapted to be printed with an advertisement thereon. An air pump is mounted in the base and is operable so as to supply fine air bubbles into the liquid body via a diffuser set which is mounted on a bottom end of the hollow member. A lamp set is mounted on the base and is disposed beneath the hollow member. The lamp set is operable so as to radiate light that extends through the bottom end of the hollow member. The lamp set includes a first lamp unit disposed adjacent to the surrounding wall, and a second lamp unit surrounded by the first lamp unit.

2 Claims, 6 Drawing Sheets

ADVERTISEMENT STAND

BACKGROUND OF THE INVENTION

1. Field of the Invention

The present invention relates to an advertisement stand, more particularly to an advertisement stand which can create lively and colorful visual effects to attract the attention of consumers.

2. Description of the Related Art

FIG. 1 shows a conventional advertisement stand 1. As shown, the advertisement stand 1 includes an upright hollow member 12 made of a translucent material and printed with an advertisement 121, which is lit by a lamp set 13 disposed within the hollow member 12. As the advertisement stand 1 is dull and unattractive in appearance, the advertising effect is not satisfactory.

SUMMARY OF THE INVENTION

Therefore, the main object of the present invention is to provide an advertisement stand that can create lively and colorful visual effects to attract the attention of consumers.

Accordingly, an advertisement stand of the present invention includes a hollow base, an upright transparent hollow member, a diffuser set, an air pump, and a lamp set. The hollow base has a top side. The hollow member is mounted on the top side of the hollow base, and confines a water-tight inner space that is adapted to be filled with a liquid body. The hollow member has top and bottom ends and a surrounding wall that extends between the top and bottom ends and that is adapted to be printed with an advertisement thereon. The diffuser set is mounted on the bottom end of the hollow member within the inner space. The air pump is mounted in the hollow base and is connected to the diffuser set. The air pump is operable so as to supply fine air bubbles into the liquid body in the inner space via the diffuser set. The lamp set is mounted on the hollow base and is disposed beneath the bottom end of the hollow member. The lamp set is operable so as to radiate light that extends upwardly through the bottom end of the hollow member. The lamp set includes a first lamp unit disposed adjacent to the surrounding wall of the hollow member, and a second lamp unit surrounded by the first lamp unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
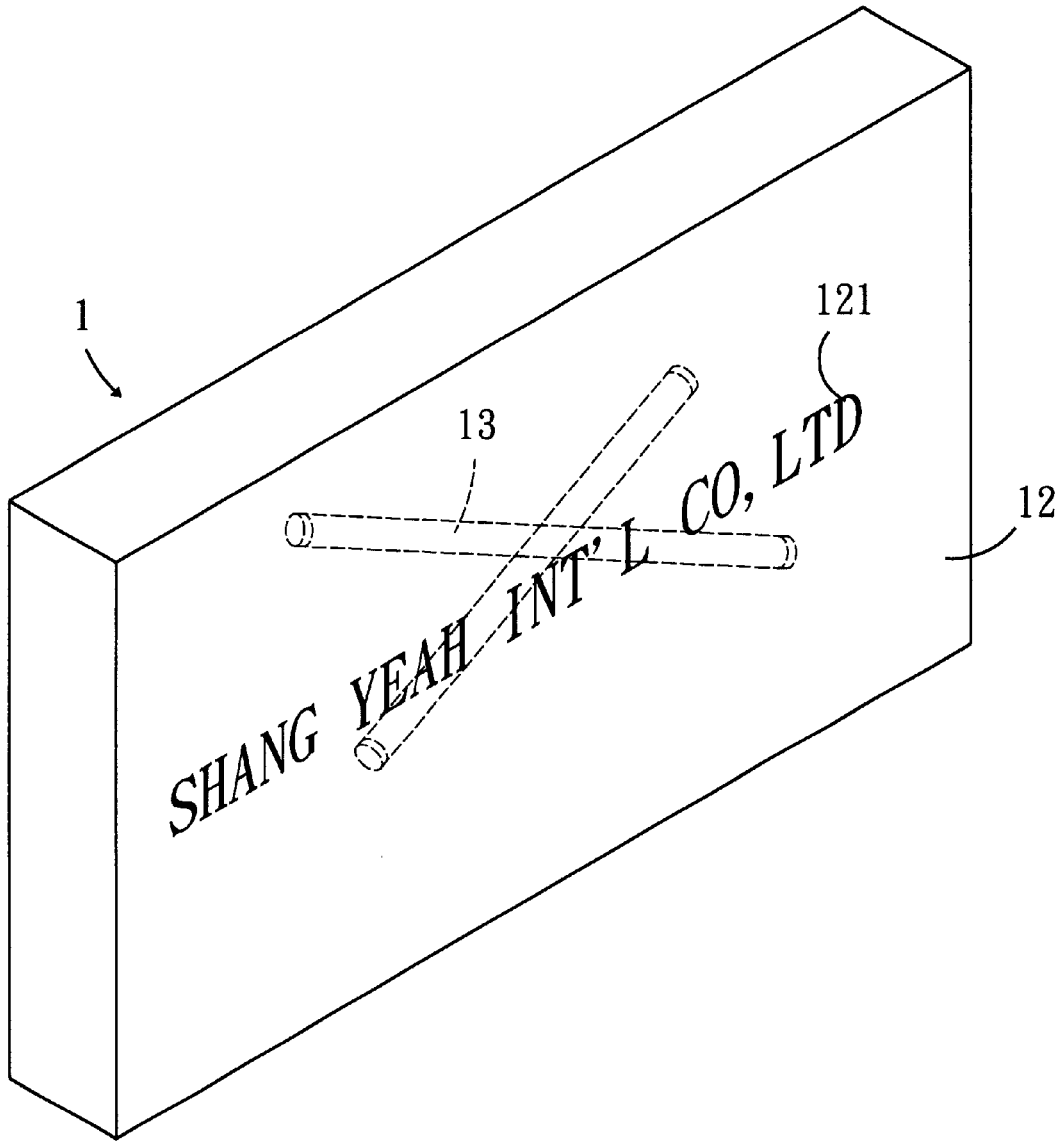
FIG. 1 PRIOR ART
FIG. 1 is a perspective view of a conventional advertisement stand.
Figure 2:
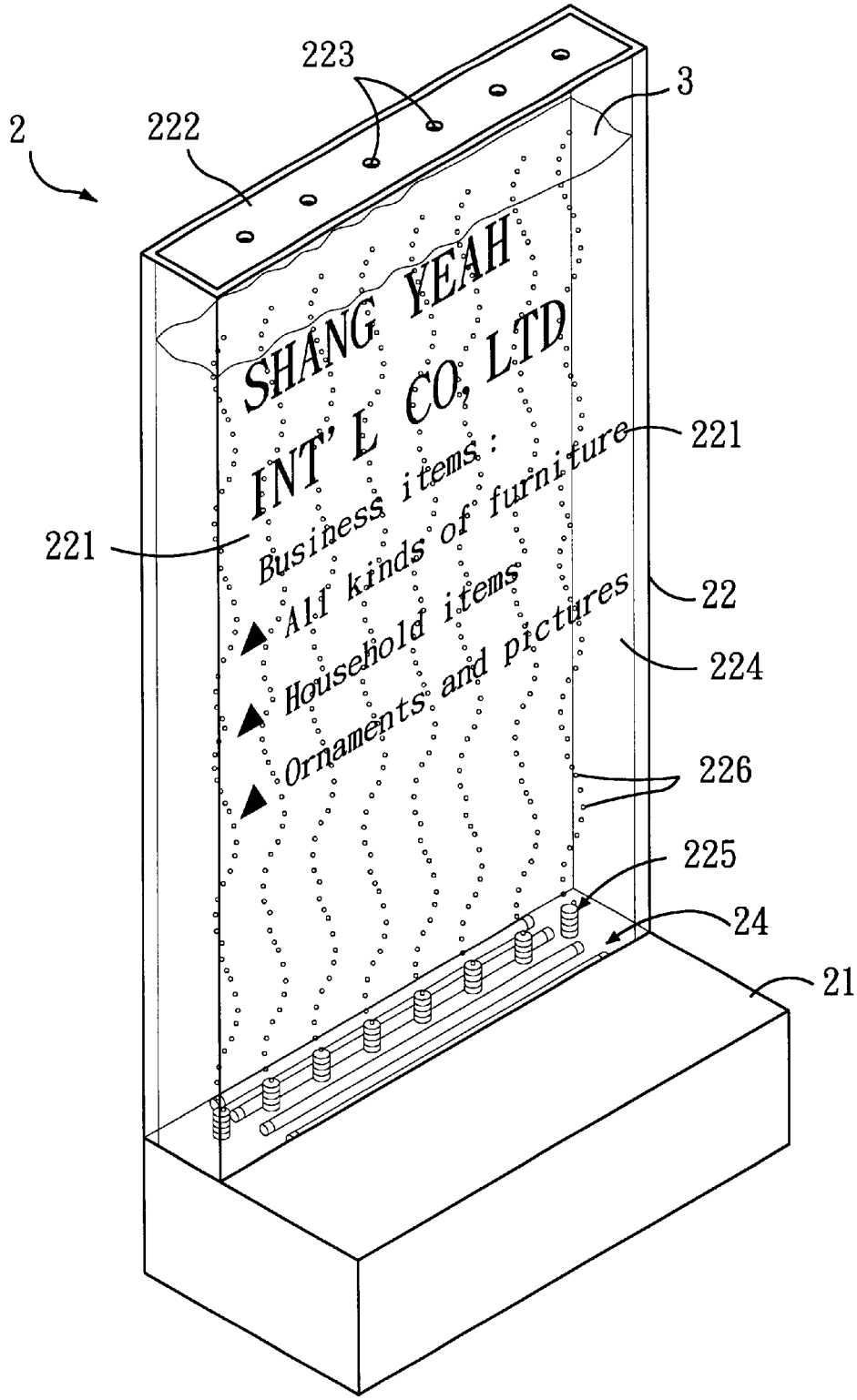
FIG. 2 is a perspective view of the first preferred embodiment of an advertisement stand according to the present invention.
Figure 3:
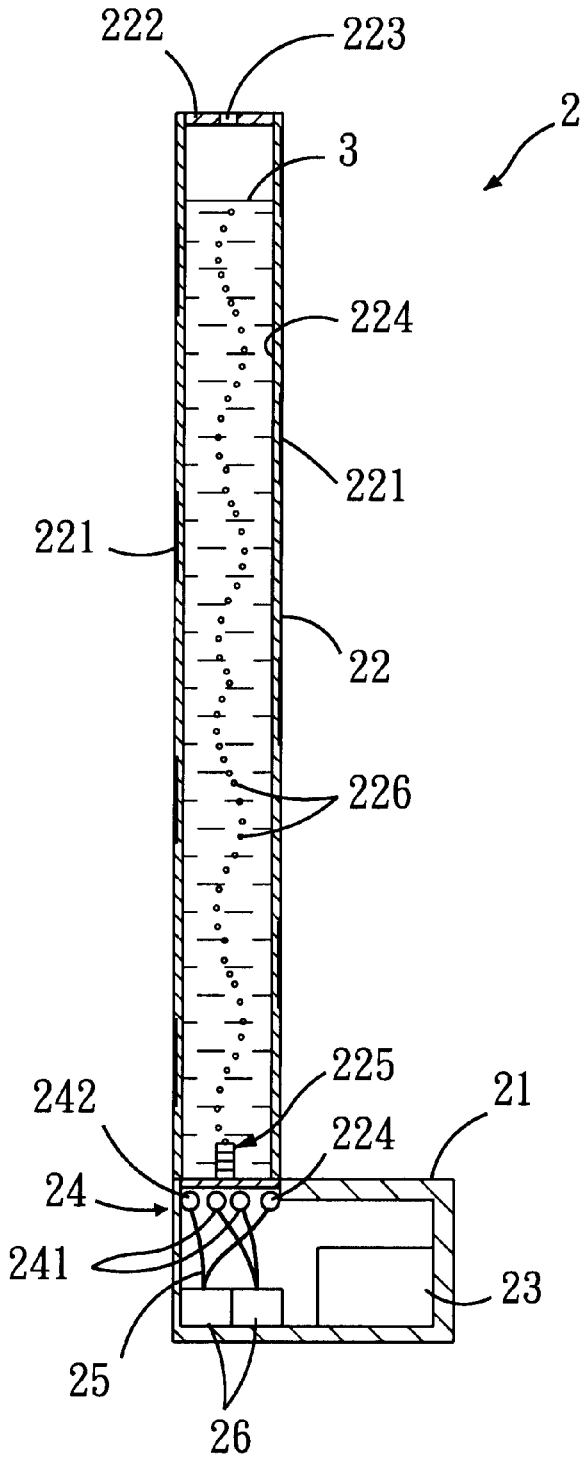
FIG. 3 is a sectional side view of the first preferred embodiment.

With reference to FIG. 2, in combination with FIG. 3, the first preferred embodiment of an advertisement stand 2 according to the present invention is shown to include a hollow base 21, an upright transparent hollow member 22, a diffuser set 225, an air pump 23 and a lamp set 24.

The hollow member 22 is mounted on a top side of the hollow base 21, and confines a water-tight inner space 224 that is adapted to be filled with a liquid body 3. The hollow member 22 has top and bottom ends and a surrounding wall that extends between the top and bottom ends and that is adapted to be printed with an advertisement 221 thereon. The hollow member 22 includes a removable cover 222 mounted removably on the surrounding wall at the top end and formed with at least one vent hole 223. A clearance is maintained between the cover 222 and the liquid body 3 inside the inner space 224. In this embodiment, the surrounding wall of the hollow member 22 has a rectangular cross-section along a horizontal plane.

The diffuser set 225 is mounted on the bottom end of the hollow member 22 within the inner space 224, and includes a plurality of spaced-apart diffusers.

The air pump 23 is mounted in the hollow base 21 and is connected to the diffuser set 225. The air pump 23 is operable so as to supply fine air bubbles 226 into the liquid body 3 in the inner space 224 via the diffuser set 225.

The lamp set 24 is mounted on the hollow base 21 and is disposed beneath the bottom end of the hollow member 22. The lamp set 24 is operable so as to radiate light that extends upwardly through the bottom end of the hollow member 22. The lamp set 24 includes a first lamp unit 242 disposed adjacent to the surrounding wall of the hollow member 22, and a second lamp unit 241 surrounded by the first lamp unit 242. In this embodiment, each of the first and second lamp units 242, 241 includes a plurality of tubular lamp members, and radiates colored light. Alternatively, the first and second lamp units 242, 241 may be configured to radiate differently colored light. By virtue of this arrangement, the first lamp unit 242 can light up the surrounding wall of the hollow member 22, while the second lamp unit 241 can light up the liquid body 3 in the hollow member 22. In the case of engraved advertisements 221, the first lamp unit 242 can further highlight the contours of the engraved words or patterns due to refraction of light. The advertisement stand 2 further includes a programmable lamp controller 26 connected electrically to the first and second lamp units 242, 241 via wire units 25 and operable so as to control activation and deactivation sequences of the first and second lamp units 242, 241.

Figure 4:
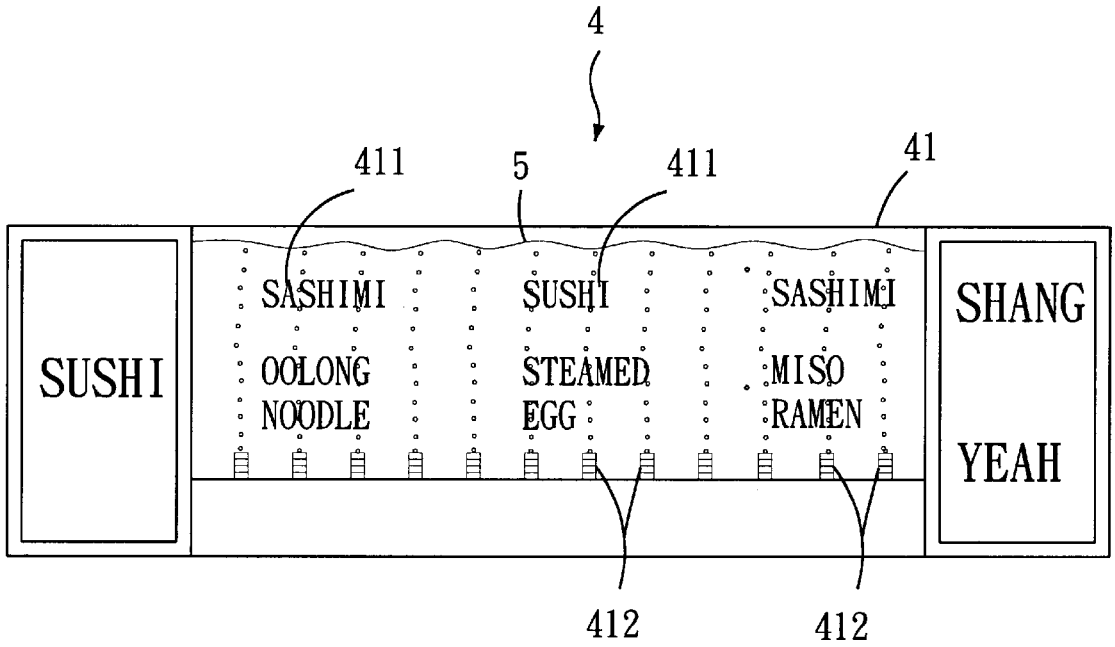
FIG. 4 is a front side view of the second preferred of an advertisement stand according to the present invention.

FIG. 4 shows the second preferred embodiment of an advertisement stand 4 according to the present invention. This embodiment differs from the previous embodiment in that the advertisement stand 4 is adapted for use as a menu stand for a Japanese restaurant, and includes a transparent hollow member 41 filled with a liquid body 5 and having a surrounding wall adapted to be printed with advertisement 411 listing dishes or foods served by the restaurant. A plurality of diffusers 412 are spacedly disposed on a bottom end of the hollow member 41.

Figure 5:
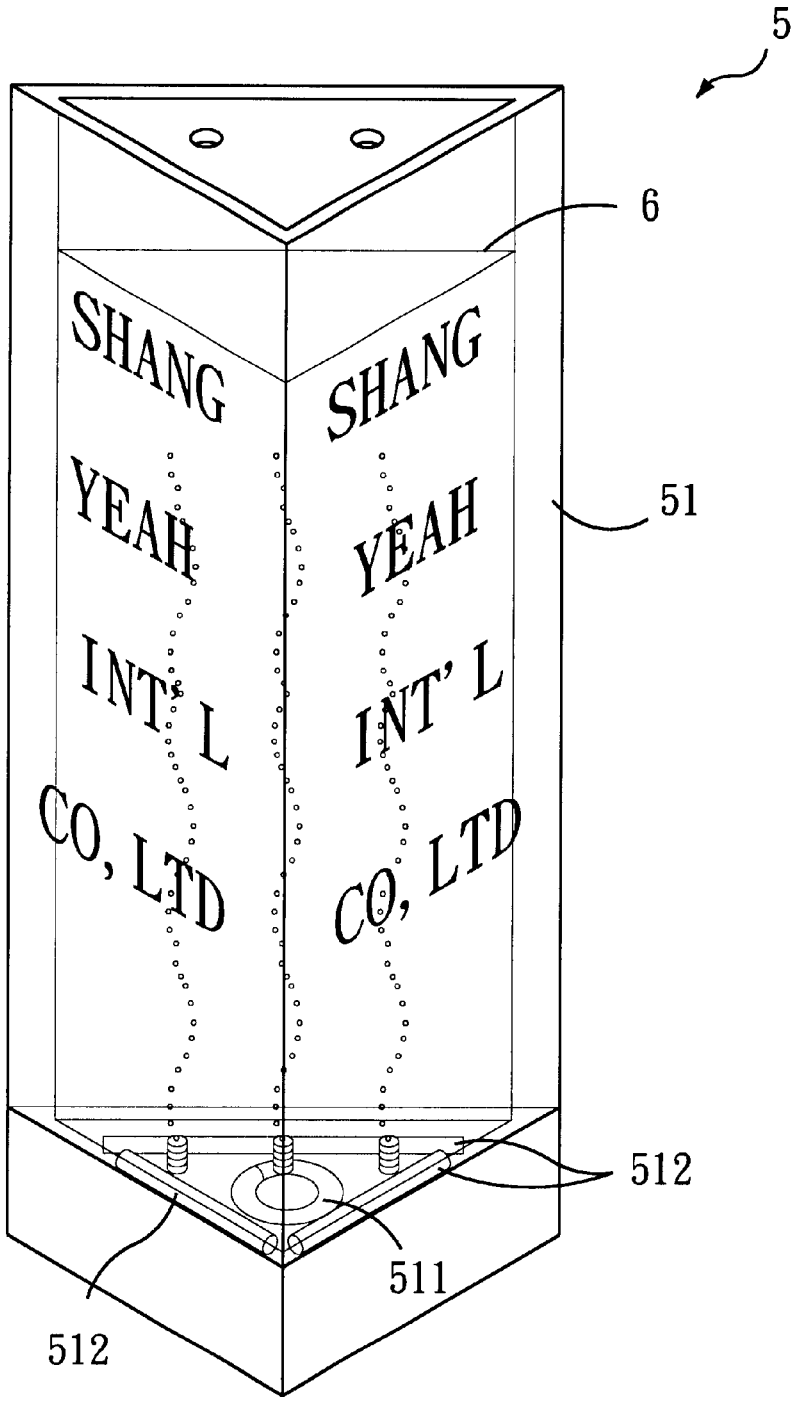
FIG. 5 is a perspective view of the third preferred embodiment of an advertisement stand according to the present invention.

FIG. 5 shows the third preferred embodiment of an advertisement stand 5 according to the present invention. This embodiment differs from the previous embodiments in that the advertisement stand 5 includes an upright transparent hollow member 51 that has a surrounding wall with a triangular cross-section along a horizontal plane, and a lamp unit which includes a first lamp unit comprising a plurality of tubular lamp members 512 that correspond in number to the number of sides of the surrounding wall and that are disposed adjacent to the sides of the surrounding wall, and a second lamp unit 511 in the form of a ring lamp member.

Figure 6:
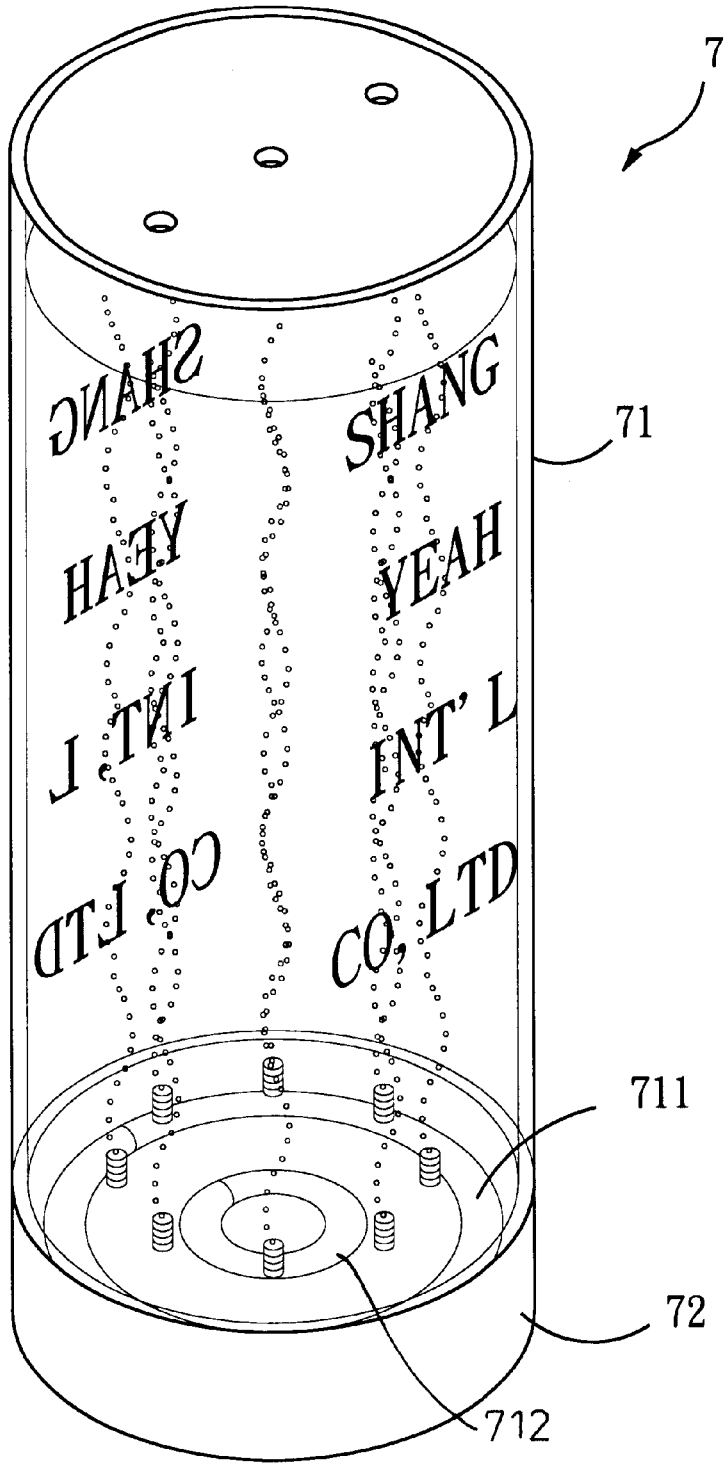
FIG. 6 is a perspective view of the fourth preferred embodiment of an advertisement stand according to the present invention.

FIG. 6 shows the fourth preferred embodiment of an advertisement stand 7 according to the present invention. The main difference between this embodiment and the previous embodiments resides in that the advertisement stand 7 includes an upright transparent hollow member 71 mounted on a circular hollow base 72 and having a circular cross-section along a horizontal plane, and a lamp set which includes first and second lamp units 711, 712 in the form of ring lamp members. The first lamp unit 711 is disposed adjacent to the surrounding wall, whereas the second lamp unit 712 is disposed adjacent to a central portion of a bottom end of the hollow member 71.

In view of the aforesaid, it can be seen that the advertisement stand according to the present invention can create lively, colorful and rich visual effects to draw consumers' attention.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An advertisement stand comprising:

a hollow base having a top side;

an upright transparent hollow member mounted on said top side of said hollow base and confining a water-tight inner space that is adapted to be filled with a liquid body, said hollow member having top and bottom ends and a surrounding wall that extends between said top and bottom ends and that is adapted to be printed with advertisement thereon;

a diffuser set mounted on said bottom end of said hollow member within said inner space;

an air pump mounted in said hollow base and connected to said diffuser set and operable so as to supply fine air bubbles into the liquid body in said inner space through said diffuser set;

a lamp set mounted on said hollow base and disposed beneath said bottom end of said hollow member, said lamp set being operable so as to radiate light that extends upwardly through said bottom end of said hollow member, said lamp set including a first lamp unit disposed adjacent to said surrounding wall of said hollow member, and a second lamp unit surrounded by said first lamp unit; and the surrounding wall of said hollow member having a polygonal cross-section along a horizontal plane, said first lamp unit including a plurality of lamp members that correspond in number to the number of sides of said surrounding wall and that are respectively disposed adjacent to the sides of said surrounding wall.

2. An advertisement stand comprising:

a hollow base having a top side;

an upright transparent hollow member mounted on said top side of said hollow base and confining a water-tight inner space that is adapted to be filled with a liquid body, said hollow member having top and bottom ends and a surrounding wall that extends between said top and bottom ends and that is adapted to be printed with advertisement thereon;

a diffuser set mounted on said bottom end of said hollow member within said inner space;

an air pump mounted in said hollow base and connected to said diffuser set and operable so as to supply fine air bubbles into the liquid body in said inner space through said diffuser set;

a lamp set mounted on said hollow base and disposed beneath said bottom end of said hollow member, said lamp set being operable so as to radiate light that extends upwardly through said bottom end of said hollow member, said lamp set including a first lamp unit disposed adjacent to said surrounding wall of said hollow member, and a second lamp unit surrounded by said first lamp unit; and said second lamp unit includes a ring lamp member.

* * * * *